US010118390B2

(12) United States Patent
Stephens et al.

(10) Patent No.: US 10,118,390 B2
(45) Date of Patent: Nov. 6, 2018

(54) SINGLE JET RECIRCULATION IN AN INKJET PRINT HEAD

(71) Applicant: XEROX CORPORATION, Norwalk, CT (US)

(72) Inventors: Terrance L. Stephens, Canby, OR (US); David A. Tence, Tualatin, OR (US); Ryan J. Evens, Wilsonville, OR (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 15/790,548

(22) Filed: Oct. 23, 2017

(65) Prior Publication Data

US 2018/0056647 A1 Mar. 1, 2018

Related U.S. Application Data

(62) Division of application No. 15/086,536, filed on Mar. 31, 2016.

(51) Int. Cl.

| | |
|---|---|
| ***B41J 2/18*** | (2006.01) |
| ***B41J 2/19*** | (2006.01) |
| ***B41J 2/14*** | (2006.01) |
| ***B41J 2/175*** | (2006.01) |
| *B41J 2/165* | (2006.01) |

(52) U.S. Cl.

CPC ..... *B41J 2/14201* (2013.01); *B41J 2/16517* (2013.01); *B41J 2/17593* (2013.01); *B41J 2/18* (2013.01); *B41J 2/19* (2013.01); *B41J 2002/14403* (2013.01); *B41J 2002/16564* (2013.01); *B41J 2202/07* (2013.01); *B41J 2202/08* (2013.01); *B41J 2202/12* (2013.01)

(58) Field of Classification Search

CPC ..... B41J 2/17593; B41J 2/16517; B41J 2/18; B41J 2/19; B41J 2002/16564; B41J 2202/07; B41J 2202/12

See application file for complete search history.

(56) References Cited

U.S. PATENT DOCUMENTS 4,961,082 A * 10/1990 Hoisington ..... B41J 2/19 347/88
5,793,394 A * 8/1998 Kato ..... B41J 2/14274 347/68
6,007,193 A * 12/1999 Kashimura ..... B41J 2/1707 347/18
6,322,203 B1 11/2001 Kitahara
8,556,372 B2 * 10/2013 Paschkewitz ..... B41J 2/17593 347/18

(Continued)

*Primary Examiner* — Julian Huffman

(74) *Attorney, Agent, or Firm* — Miller Nash Graham & Dunn LLP

(57) ABSTRACT

An inkjet print head including a plurality of single jet elements. Each of the single jet elements includes an aperture configured to eject ink during a jetting event, and a channel for receiving ink, the channeling including a recirculation portion configured to receive ink during a non-jetting event. The print head also includes a first manifold structured to supply ink to the channel, and a second manifold structured to receive ink from the recirculation portion of the channel. The ink flows from the inlet portion to the second outlet portion during non-jetting through the second outlet portion.

20 Claims, 3 Drawing Sheets

(56) References Cited

U.S. PATENT DOCUMENTS

| | | | | |
|---|---|---|---|---|
| 8,562,117 | B2 * | 10/2013 | Limb | B41J 2/17593 347/88 |
| 8,746,860 | B2 * | 6/2014 | Delueg | B41J 2/1707 347/17 |
| 2010/0214380 | A1 | 8/2010 | Essen | |
| 2015/0306875 | A1 | 10/2015 | Nishimura | |
| 2017/0182788 | A1 * | 6/2017 | Tokimatsu | B41J 2/175 |

* cited by examiner

SINGLE JET RECIRCULATION IN AN INKJET PRINT HEAD

CROSS REFERENCE TO RELATED APPLICATION

This application is a divisional of U.S. patent application Ser. No. 15/086,536, filed Mar. 31, 2016, which is incorporated herein in its entirety by reference.

TECHNICAL FIELD

This disclosure relates to inkjet print heads, more particularly to recirculation of ink flows in a print head.

BACKGROUND

Typically, a solid ink print head contains a reservoir into which molten ink is fed using a drip feed, or umbilical feed system. The print head also contains an array of jetting elements that are attached to a nozzle plate having an array of apertures through which ink exits to form an image on a print surface. Inside the print head, the ink flows from the reservoir to the jetting elements and nozzle plate through a series of channels or manifolds. These channels or manifolds within the print head are typically formed by a combination of discrete layers that are bonded together to form the overall fluidic structure.

Through the use of heaters, the print head is heated such that the solid ink within the print head melts, or becomes liquid during normal operation. During long periods of idleness, or after powering down, the heaters turn off. The associated cooling of the print head causes the ink within the print head to solidify and shrink. This, in turn, causes air to be introduced into the channels or manifolds within the print head. Upon the subsequent power-up, this air manifests itself as air bubbles within the fluidic structure. For the print head to perform correctly, all or substantially all of this air must be removed from the channels or manifolds internal to the print head.

One should note that the terms 'printer' and 'print head' apply to any structure or system that produces ink onto a print surface whether part of a printer, a fax machine, a photo printer, etc.

Traditional air removal approaches generate waste ink that the system cannot reclaim or reuse. For example, in one approach, the system transports air bubbles to locations along the channels or manifolds, where they can exit the print head through vent holes that are not part of the nozzle plate. In another approach, the system forces the air through the jetting elements and associated nozzles themselves. In yet another approach, the system forces the air through vents or nozzles within the nozzle plate that are not associated with a jetting element. In each of these approaches, ink trapped between the air bubble and the vent or jetting elements also exits the print head. The printers cannot easily reclaim this ink, and it becomes waste.

With the advent of more stringent energy savings requirements, the printer will be required to power down more frequently than is currently required. Correspondingly, the need for purge cycles to remove air introduced into the print head during power down will also increase. This will contribute to more waste ink, resulting in less efficient print heads, higher user costs and unsatisfied customers.

SUMMARY

One embodiment is an inkjet print head that includes a plurality of single jet elements, each single jet element including an aperture configured to eject ink during a jetting event, and a channel for receiving ink. The print head also includes a first manifold structure connected to the channel, a plurality of recirculation channels connected to the channel for receiving ink, the recirculation channel is formed by half-etching one of the steel plates that forms part of the each of the single jet elements and the recirculation path and a second manifold structure connected to the recirculation channel. A negative pressure is applied to the first manifold and a lower negative pressure is applied to the second manifold for a predetermined amount of time prior to the jetting event.

Another embodiment is an inkjet print head including a jet element. The jet element includes an aperture configured to eject ink during a jetting event, and a channel for receiving ink. The inkjet print head also includes a first manifold structured to supply ink to the channel, and a recirculation path configured to receive ink during the jetting event and a non-jetting event. Each recirculation path includes a recirculation channel connected to the channel for receiving ink, the recirculation channel is formed by half-etching one of the steel plates that forms part of the each of the single jet elements and the recirculation paths, and a second manifold structured to receive ink from the recirculation channel, wherein the ink flows from the first manifold to the second manifold through the jet element and the recirculation path during a non-jetting event.

Another embodiment is a method of controlling pressures in a print head. The method includes heating ink to a desired temperature, applying a negative pressure to a first manifold connected to a channel and a lower negative pressure at a second manifold connected to a recirculation channel for a predetermined amount of time after the ink is heated to a desired temperature, and ejecting ink through an aperture after the predetermined amount of time has elapsed.

DETAILED DESCRIPTION OF THE EMBODIMENTS

Some fluid dispensing assemblies include a local fluid supply and a fluid dispensing subassembly. The local fluid supply may reside in one or more reservoir chambers within a reservoir assembly. The fluid dispensing subassembly may be viewed as having several components. First, the driver component may consist of the transducer, such as a piezoelectric transducer, that causes the fluid to exit the subassembly, the diaphragm upon which the transducer operates, and the body plate or plates that form the pressure chamber. Second, an inlet component consists of the channel that directs the fluid from the manifold toward the pressure chamber. Next, the outlet component directs the fluid from the pressure chamber to the aperture. Finally, the aperture itself dispenses fluid out of the print head.

A print head serves as an example of a fluid dispensing assembly, with a jet stack acting as the fluid dispensing subassembly, the jet stack typically consisting of a set of plates bonded together. In the print head/jet stack example, the four components of driver, inlet, outlet and aperture become more specific. The inlet directs the ink from a manifold towards a pressure chamber, and the outlet directs the ink from the pressure chamber to the aperture plate. The driver operates on the ink in the pressure chamber to cause the fluid to exit the jet stack through the aperture plate. In the example of a jet stack, the aperture dispenses fluid out of the jet stack and ultimately out of the print head.

The term printer as used here applies to any type of drop-on-demand ejector system in which drops of fluid are forced through one aperture in response to actuation of some sort of transducer. This includes printers, such as thermal ink jet printers, print heads used in applications such as organic electronic circuit fabrication, bioassays, three-dimensional structure building systems, etc. The term 'print head' is not intended to only apply to printers and no such limitation should be implied. The jet stack resides within the print head of a printer, with the term printer including the examples above.

Figure 1:
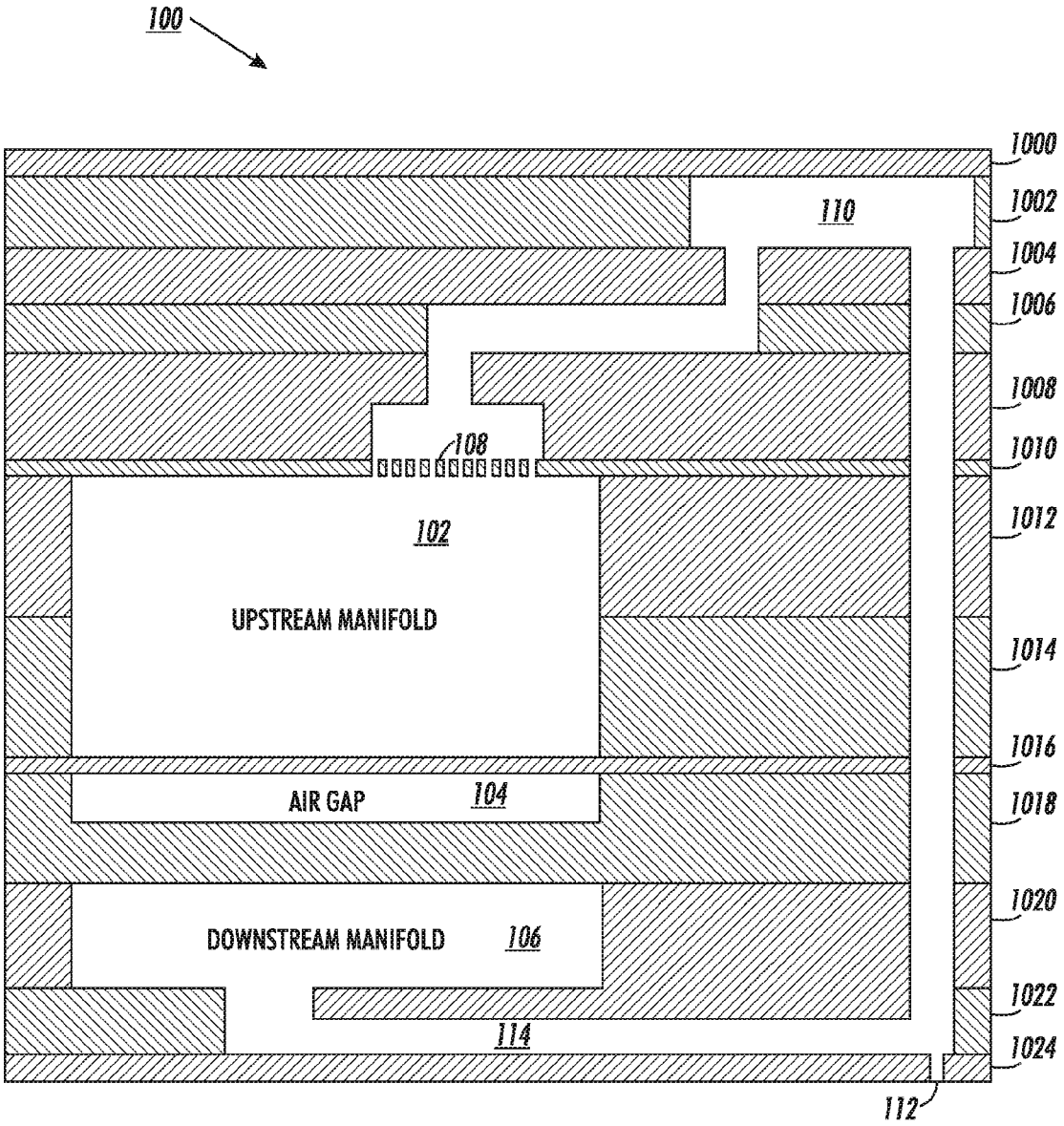
FIG. 1 shows an example of a fluid dispensing subassembly of a single jet element.

The disclosed technology solves the problem of wasting ink when removing air bubbles in an ink flow path. FIG. 1 shows an example of a jet stack in a print head. The jet stack 100 consists of a set of plates bonded together in this example and will be used in the discussion. It should be noted that this is just an example and no limitation to application or implementations of the invention claimed here. As will be discussed further, the terms 'printer' and 'print head' may consist of any system and structure within that system that dispenses fluid for any purpose. Similarly, while a jet stack will be discussed here to aid in understanding, any fluid dispensing subassembly may be relevant. The fluid dispensing subassembly or fluid dispensing body may be comprised of a set of plates, as discussed here, a molded body that has the appropriate channels, transducers, and apertures, a machined body, etc. As aspects of the embodiments include additional structures inside the jet stack than just the plates, the set of plates may be referred to as the fluid dispensing body within the fluid dispensing subassembly.

As mentioned above, the jet stack 100 consists of a plurality of plates 1000-1024. Preferably, each of the plurality of plates 1000-1024 is a stainless steel plate. Plate 1000 has a piezoelectric element (not shown) attached that facilitates ink ejection during a jetting event. Each of the plates 1000-1024 is chemically etched so that when the plurality of plates 1000-1024 are stacked they create the upstream manifold 102, the air gap 104, the downstream manifold 106, the particle filter 108, the channel 110, and the aperture 112.

To create the various components of the jet stack, the plurality of plates 1000-1024 are chemically etched from one or both sides. As mentioned above, when the plates 1000-1024 are stacked together, the chemically etched portions of the plates 1000-1024 create the various components of the jet stack. The aperture 112 is a hole through plate 1024. To create the channel 110, plates 1000-1024 are etched. To create recirculation channel 114, plate 1022, however, is only etched from one side to create a half-etched channel that leads to the downstream manifold 106. Preferably, the recirculation channel 114 is 1.65 mm to 4.445 mm long, 0.076 mm to 0.152 mm wide and 0.0381 mm to 0.1016 mm deep. However, the channel 106 is not limited to this length, width, and depth, but may be any size necessary for each jet element.

The jet stack receives ink from a reservoir (not shown) through upstream manifold 102 having a particle filter 108. The output from the particle filter 108 flows into channel 110. The channel 110 directs liquid to aperture 112 and recirculation channel 114. The particle filter 108 prevents large particles from flowing into the channel 110 and ejecting through aperture 112 or being sent to the downstream manifold 106. When an actuator or transducer (not shown) activates, it causes a diaphragm plate to deflect, and causes ink to flow through aperture 112. The ink drops exiting the aperture 112 form a portion of a printed image. The part of the ink path that includes the particle filter 108, upstream manifold 102, channel 110, and aperture 112 is referred to as the "single jet element." The recirculation path includes recirculation channel 114 and downstream manifold 106. Recirculation channel 114 is connected to channel 110.

When the actuator or transducer are not activated, ink in channel 110 flows to recirculation channel 114 and downstream manifold 106 without ejecting through the aperture 112, as will be discussed in more detail below. This allows the ink to continue to flow without an ejection and prevent the ink from becoming quiescent.

During a non-jetting event, ink flows through channel 110 and to the aperture 112 and the recirculation channel 114. However, since, as mentioned above, the pressure is not enough during a non-jetting event to break the meniscus of the ink in the aperture 112, the pressure drives the ink to the downstream manifold 106 to be recirculated. This keeps the ink flowing through the manifolds 102 and 106 and the single jet element 200 even when ink is not being ejected during a jetting event. That is, ink constantly moves throughout the single jet element 200 even when there is no jetting event. This eliminates the ink settling and causing particles to be suspended within the ink. This is accomplished by having a suitable pressure differential between the upstream manifold 102 and the downstream manifold 106.

The range of pressure required to move ink into the half-etched portion of channel 110 rather than through aperture 112 is a function of the surface tension and viscosity of the fluid. The pressure differential should be high enough to maintain flow between the upstream manifold 102 and downstream manifold 106, but low enough to prevent rupture of the aperture 112 meniscus.

Figure 2:
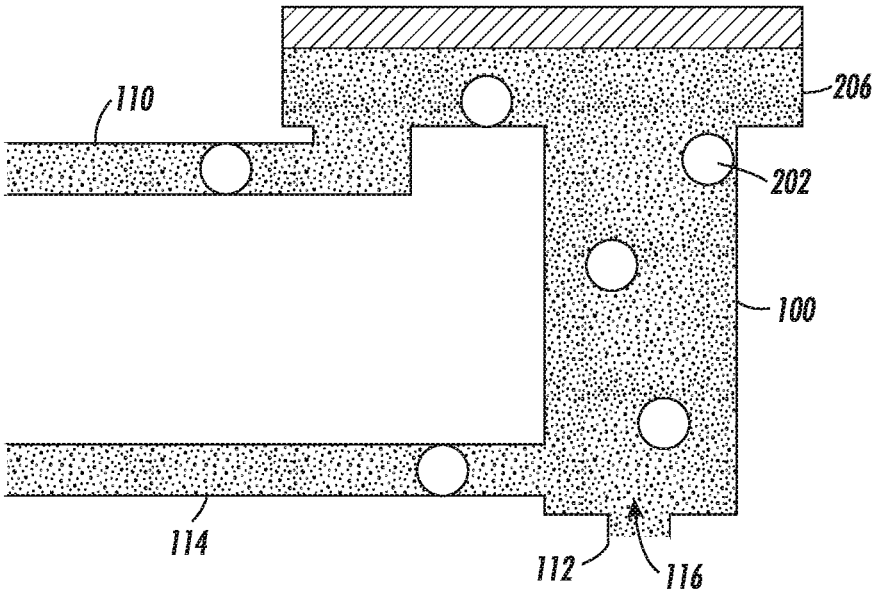
FIG. 2 shows a single jet element with air bubbles after a solid ink has been heated.

FIG. 2 shows an example of a portion of a jet stack 100 with bubbles in the ink, which will be referred to as a fluidic structure. The fluidic structure may consist of any structure that transports fluid from a reservoir to one or more jetting elements and their associated nozzles. The discussion here will focus on a print head within a print system for ease of understanding, but the embodiments described here may apply to any fluidic structure. No limitation to any particular fluidic structure is intended and none should be implied.

In this example, the fluidic structure includes channel 110 that contains a fluid, or ink, 206. In some instances, the reservoir receives a pressure that drives the fluid through channel 110 into the recirculation channel 114 within the fluidic structure 100.

As discussed above, air may be introduced into the fluidic structure during power down cycles of the print head. One should also note that under certain circumstances it is possible for air to be introduced into the fluid structure during normal operation as well.

In FIG. 2, one can see that air bubbles, such as 202, have become trapped in the channel 110. Prior to normal operation, the system needs to remove these air bubbles through the use of a purge cycle. If the system does not remove the bubbles prior to normal operation, they will adversely affect the performance of the fluidic structure. In current fluidic structures, the air bubbles are typically forced to exit directly through vents not within the nozzle plate, vents within the nozzle plate, or through the jetting elements themselves. In each of these approaches, ink trapped between the air bubble and the vent or jetting elements also exits the print head. The printer cannot easily reclaim this ink and it becomes waste.

As discussed above, FIG. 2 shows an embodiment of a single jet element 100 with air bubbles 202 within the channel 110 and the recirculation channel 114. The single jet element 100 also includes an aperture 112. Ink 206 ejects through the aperture 112 during the ink jetting event. If air bubbles 202 are in the ink 206 during a jetting event, the jet may not operate, as discussed above.

Figure 3:
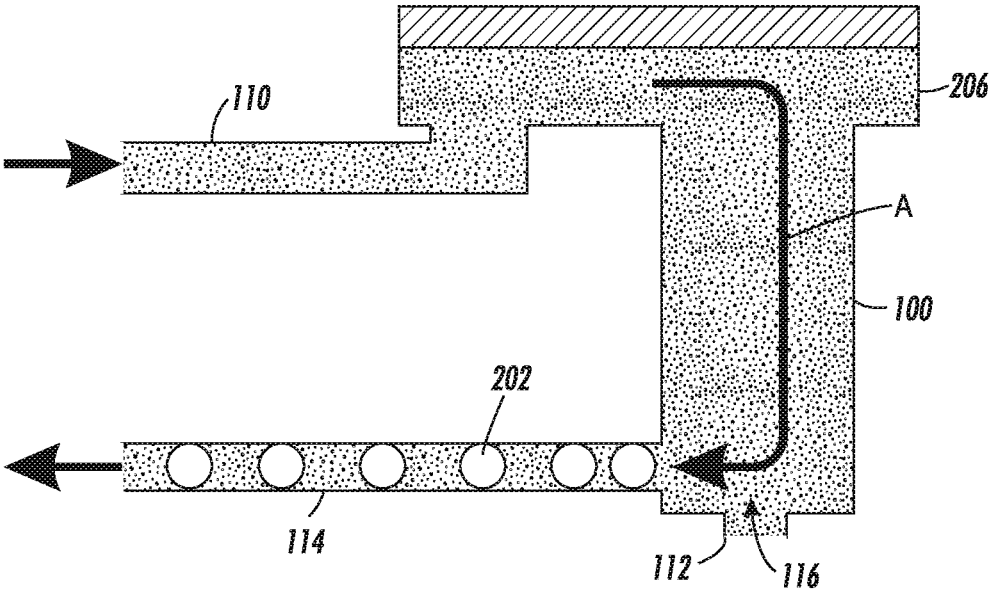
FIG. 3 shows a single jet element with internal recirculation of ink.

FIG. 3 shows the air bubbles moving through recirculation channel 114 so that the bubbles are removed from channel 110 and not expelled from the aperture 112. Ink 206 and air bubbles 202 flow from channel 110 through the body of the single jet element 100 to the recirculation channel 114 in the direction of arrow A during a non-jetting event. The meniscus 116 of the ink in the aperture 112 is maintained as the ink recirculates to remove the air bubbles 202. Therefore, no ink 206 is ejected through the aperture 112 during this process. The ink 206 from the recirculation channel 114 goes back into the downstream manifold 106. Ink 206 continues to be pumped into channel 110 from the upstream manifold 102 without air bubbles 202.

Figure 4:
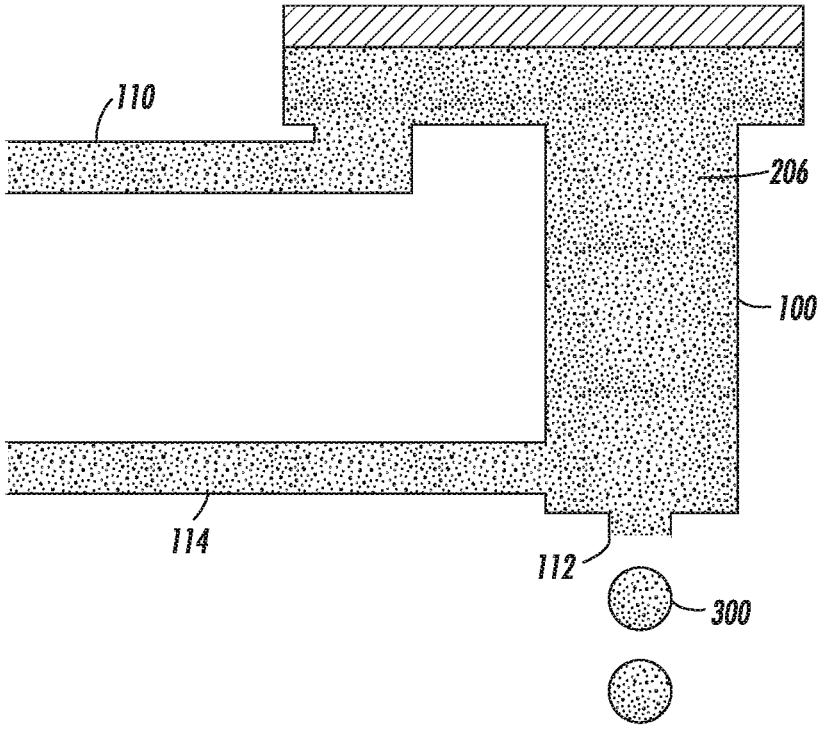
FIG. 4 shows a single jet element with air bubbles removed ejecting ink.

The ink 206 flows for a predetermined amount of time to outlet path 114 without ejecting ink 206 through aperture 112. When the predetermined amount of time has elapsed, ink 206 ejection begins as shown in FIG. 4. FIG. 4 shows the single jet element 100 clear of air bubbles 202. At this point, ink 206 is ejected through the aperture 112 to form ink droplets 300 which form images on a print substrate.

The recirculation process is performed by having a pressure differential between the upstream manifold 102 and the downstream manifold 106. During a jetting event, the pressure at the aperture 112 is less than the pressure at the outlet path 304. This allows ink to be ejected through the aperture 112 onto print media.

Before a printing operation, the ink 206 in the single jet element 100 heats up to a desired temperature for printing. Since ink 206 has solidified, air bubbles 202 form in the ink 206 when heated up, as discussed above. Prior to ink ejection through aperture 112, a negative pressure is applied at the upstream manifold 102 and a lower negative pressure is applied at the downstream manifold 106. Ink 206 flows from the upstream manifold 102 to the recirculation channel 114 and the downstream manifold 106 for a predetermined amount of time. This allows air bubbles 202 to be removed as discussed above. After the predetermined amount of time, a jetting event may take place through aperture 112 without the air bubbles 202 being present. During jetting, the pressure differential between the upstream manifold 102 and the downstream manifold 106 may be maintained. Generally, it takes about 1 atmosphere of pressure to break the meniscus 116 of the ink 206 in the aperture 112 for a jetting event. This pressure may be applied by any means, such as a vacuum, negative pressure head, etc.

The pressure required to force a bubble into the recirculation channel 114 is determined using the following equation:

$$P = T * \left(\left(\frac{2}{w}\right) + \left(\frac{2}{d}\right)\right), \tag{1}$$

where P is the pressure, T is the surface tension of the ink 202, w is the channel width, and d is channel depth. Using the channel width and depth descried above for the recirculation path 114, the range of pressure required to force a bubble into the recirculation path is 3.6 to 8.5 inches of water based on a surface tension of 27 dyne/cm for the ink 206. That is, the pressure difference at the entrance of the recirculation path 114 must be equal to or greater than the pressure determined using equation (1) above.

This allows ink to be recirculated through the single jet element 100, rather than conduct preliminary ejection prior to printing to remove air bubbles 202. Ink 206 is saved since it is recirculated back through the reservoir (not shown). The ink 206 with air bubbles 202 poses no threat of blockage during printing when moved to the reservoir, and ink 206 is not wasted while trying to remove the air bubbles 202.

Although a single jet element 100 is discussed above, a print head includes a plurality of single jet elements 100. Each of the single jet elements 100 is configured as discussed above. Further, each of the single jet elements 100 connects to the upstream manifold 102 and the downstream manifold 106 which holds the ink 206 and from which ink 206 is pumped into the single jet element 100, as shown, for example, in FIG. 1.

It will be appreciated that several of the above-disclosed and other features and functions, or alternatives thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. A method of controlling pressures in a print head, comprising:

heating ink to a desired temperature;

applying a negative pressure to a first manifold connected to a channel and a lower negative pressure at a second manifold connected to a recirculation channel for a predetermined amount of time after the ink is heated to a desired temperature; and ejecting ink through an aperture after the predetermined amount of time has elapsed.

2. The method of claim 1, wherein the surface tension of the ink is 27 dyne/cm and the pressure at the second manifold is between 3.6 to 8.5 inches of water.

3. The method of claim 1, wherein a pressure difference at the entrance to the recirculation path must be equal to or greater than a pressure determined by the following equation:

$$P = T * \left(\left(\frac{2}{w}\right) + \left(\frac{2}{d}\right)\right),$$

where P is the pressure, T is the surface tension of the ink, w is a width of the recirculation channel, and d is a depth of the recirculation channel.

4. The method of claim 1, wherein the negative pressure applied to the first manifold and the lower negative pressure applied at the second manifold is less than the amount of pressure required to break a meniscus of ink located at the aperture of a jet element.

5. The method of claim 1, wherein the negative pressure and the lower negative pressure are determined based on a width and a depth of the recirculation channel.

6. The method of claim 5, wherein the recirculation channel is 1.65 mm to 4.445 mm long, 0.076 mm to 0.152 mm wide and 0.0381 mm to 0.1016 mm deep.

7. A method of controlling pressure in a jet element, comprising:

heating ink in the jet element to a desired temperature;

when the ink reaches the desired temperature, applying a negative pressure to a first manifold of the jet element connected to a channel and a lower negative pressure at a second manifold connected to a recirculation channel for a predetermined amount of time after the ink is heated to a desired temperature, wherein the negative pressure and the lower negative pressure are determined based on a size of the recirculation channel; and ejecting ink through an aperture of the jet element after the predetermined amount of time has elapsed.

8. The method of claim 7, wherein the negative pressure and the lower negative pressure are determined based on a width and a depth of the recirculation channel.

9. The method of claim 7, wherein a pressure difference between the negative pressure and the lower negative pressure at the entrance to the recirculation path must be equal to or greater than a pressure determined by the following equation:

$$P = T*\left(\left(\frac{2}{w}\right)+\left(\frac{2}{d}\right)\right),$$

where P is the pressure, T is the surface tension of the ink, w is a width of the recirculation channel, and d is a depth of the recirculation channel.

10. The method of claim 9, further comprising maintaining the pressure differential between the first manifold and the second manifold is maintained during a jetting event.

11. The method of claim 7, wherein the negative pressure applied to the first manifold and the lower negative pressure applied at the second manifold is less than the amount of pressure required to break a meniscus of ink located at the aperture of each single jet element.

12. The method of claim 7, wherein the recirculation channel is 1.65 mm to 4.445 mm long, 0.076 mm to 0.152 mm wide and 0.0381 mm to 0.1016 mm deep.

13. The method of claim 7, further comprising:

heating ink in a plurality of jet elements to a desired temperature;

when the ink reaches the desired temperature in each jet element, applying a negative pressure to a first manifold of a respective jet element connected to a channel and a lower negative pressure at a second manifold connected to a recirculation channel for a predetermined amount of time after the ink is heated to a desired temperature, wherein the negative pressure and the lower negative pressure are determined based on a size of the recirculation channel; and ejecting ink through an aperture of the respective jet element after the predetermined amount of time has elapsed.

14. A method of controlling pressure in a jet element, comprising:

heating ink in the jet element to a desired temperature; and when the ink reaches the desired temperature, applying a negative pressure to a first manifold of the jet element connected to a channel and a lower negative pressure at a second manifold connected to a recirculation channel for a predetermined amount of time after the ink is heated to a desired temperature, wherein the negative pressure and the lower negative pressure are determined based on a size of the recirculation channel.

15. The method of claim 14, wherein the negative pressure and the lower negative pressure are determined based on a width and a depth of the recirculation channel.

16. The method of claim 14, wherein a pressure difference between the negative pressure and the lower negative pressure at the entrance to the recirculation path must be equal to or greater than a pressure determined by the following equation:

$$P = T*\left(\left(\frac{2}{w}\right)+\left(\frac{2}{d}\right)\right),$$

where P is the pressure, T is the surface tension of the ink, w is a width of the recirculation channel, and d is a depth of the recirculation channel.

17. The method of claim 16, further comprising maintaining the pressure differential between the first manifold and the second manifold is maintained during a jetting event.

18. The method of claim 14, wherein the negative pressure applied to the first manifold and the lower negative pressure applied at the second manifold is less than the amount of pressure required to break a meniscus of ink located at the aperture of the jet element.

19. The method of claim 14, wherein the recirculation channel is 1.65 mm to 4.445 mm long, 0.076 mm to 0.152 mm wide and 0.0381 mm to 0.1016 mm deep.

20. The method of claim 14, further comprising:

heating ink in a plurality of jet elements to a desired temperature; and when the ink reaches the desired temperature in each jet element, applying a negative pressure to a first manifold of a respective jet element connected to a channel and a lower negative pressure at a second manifold connected to a recirculation channel for a predetermined amount of time after the ink is heated to a desired temperature, wherein the negative pressure and the lower negative pressure are determined based on a size of the recirculation channel.

* * * * *